US005135335A

United States Patent [19]

Stephens et al.

[11] Patent Number: 5,135,335

[45] Date of Patent: Aug. 4, 1992

[54] HYDRAULIC JACKING APPARATUS

[76] Inventors: Jerry B. Stephens, 4725 Lamar Ave., Paris, Tex. 75460; Richard E. Jackson, Rte. 1, Box 443; David H. Conder, Rte. 1, Box 211, both of Powderly, Tex. 75473

[21] Appl. No.: 652,666

[22] Filed: Feb. 8, 1991

Related U.S. Application Data

[62] Division of Ser. No. 491,721, Mar. 12, 1990, Pat. No. 5,006,015.

[51] Int. Cl.[5] ..... E02D 5/00; E02D 27/48

[52] U.S. Cl. ..... 405/230; 405/229

[58] Field of Search ..... 405/230, 229, 303; 254/29 R

[56] References Cited

U.S. PATENT DOCUMENTS

| | | | |
|---|---|---|---|
| 570,370 | 10/1896 | Breuchaud . | |
| 2,982,103 | 5/1961 | Revesz et al. . | |
| 3,796,055 | 3/1974 | Mahony . | |
| 3,852,970 | 12/1974 | Cassidy . | |
| 3,902,326 | 9/1975 | Langenbach, Jr. . | |
| 4,012,917 | 3/1977 | Gendron . | |
| 4,070,867 | 1/1978 | Cassidy . | |
| 4,765,777 | 8/1988 | Gregory | 405/230 |
| 4,925,345 | 5/1990 | McCown, Jr. et al. | 405/232 |

FOREIGN PATENT DOCUMENTS

| | | | |
|---|---|---|---|
| 1418164 | 12/1975 | United Kingdom | 405/230 |

*Primary Examiner*—Dennis L. Taylor

*Attorney, Agent, or Firm*—Laney, Dougherty, Hessin & Beavers

[57] ABSTRACT

Apparatus for simultaneously driving two parallel pile members that function to raise and reposition building foundation structures. The apparatus consists of a foundation support member, a frame assembly removably attached to the foundation support member, and a hydraulic ram and pile gripping assembly supported within said frame assembly. Alternately, the apparatus consists of a foundation support member, a pile gripping assembly, and a hydraulic ram removably interconnected between said foundation support member and said pile gripping assembly. As the hydraulic ram is actuated, the pile gripping assembly grips the pile members upon the start of downward movement relative to the pile members and completion of the stroke drives the pile members into the earth to a predetermined point of resistance. The apparatus then functions to raise and reposition the foundation after which the foundation is held in place by the pile members.

4 Claims, 5 Drawing Sheets

HYDRAULIC JACKING APPARATUS

This is a divisional of copending application Ser. No. 07/491,721 filed on Mar. 12, 1990, now U.S. Pat. No. 5,006,015.

BACKGROUND OF THE INVENTION

1. Field of the Invention

This invention relates generally to hydraulic jacking devices and, more particularly but not by way of limitation, it relates to an improved apparatus for raising and supporting a foundation or concrete slab of a building by utilizing metal pilings driven to load supporting underground strata.

2. Description of the Prior Art

Houses and other buildings are often erected on foundation members or concrete slabs which are not in direct contact with stable, load supporting underground strata. If the initial construction of the foundation or slab is improper or if soil conditions change, settling of the foundation or slab may occur. This may result in major structural damage to the foundation members and to the building. If uncorrected, eventual collapse of the building may occur.

The prior art for correction of this type of problem includes numerous types of foundation jacking apparatus that utilize one or more powered jacks to place a support structure such as a metal piling beneath or adjacent to the sunken foundation. These prior types of apparatus are such that the piling is driven to a sufficient depth that it bears against bedrock or other subsurface body or that the piles experience sufficient skin friction to provide stable support for the foundation and building.

U.S. Pat. No. 2,982,103 provides an early teaching wherein a single hydraulic jack is used in-like with a pile to apply expansive force between a load plate and a subsurface load bearing earth structure. The plate is rigidly attached to the foundation wall thereby to adjust the wall level in accordance with hydraulic jack actuation. This patent discloses the basic method for underpinning of a building or foundation.

U.S. Pat. No. 3,796,055 discloses another apparatus and variation of method for carrying out foundation underpinning. This method used hydraulic jacks within a pit that is formed alongside the foundation to be raised. A concrete pad is formed within the pit to provide a jacking base to support the hydraulic jack operation. U.S. Pat. No. 3,902,326 teaches apparatus having a single in-line hydraulic actuator that is disposed to drive a piling downward until it encounters bedrock or other firm footing. The jacking apparatus if firmly attached in support of the foundation and the foundation level can then be adjusted relative to the piling member support. U.S. Pat. No. 4,765,777 is a most recent teaching of foundation jack apparatus wherein two extended hydraulic actuators are each attached at one end to the foundation and at the other end to a yoke gripping a piling member and the actuator pistons are drawn inward while pulling the piling member and driving it downward into the earth to bedrock or substantial support.

While it is possible in some instances to drive the support pile into firm contact with actual bedrock, in many instances limitations in the placement apparatus or job site conditions allow for the pile to be driven to a depth short of actual bedrock. In these instances, a combination of the increased load bearing capability of the subsurface strata reached by the end of the pile and skin friction between the pile and surrounding strata (reference U.S. Pat. No. 4,070,867) are relied upon to support the pile which in turn supports the foundation and building. In these cases it is advantageous to increase the number of piles used to support the foundation so as to distribute the total load, thus guarding against future settling of the foundation in the event of slight changes in the subsurface conditions. Prior art techniques would require additional apparatus to be used so a to place additional piles singularly. The present invention overcomes the limitations of prior art apparatus by simultaneously driving two pile members in parallel using one apparatus.

SUMMARY OF THE INVENTION

The present invention relates to a foundation jacking pile driver apparatus that utilizes one hydraulic actuator to drive two pile members simultaneously with the expansion stroke. The apparatus consists of a foundation support secured to the underside of a building foundation with a frame assembly extending upward from the foundation support. Two pile guide sleeves are affixed vertically to the foundation support in line with a pile gripper assembly. The hydraulic actuator is connected between the frame assembly and the pile gripper assembly so that extension of the actuator by the application of fluid power against the actuator's piston results in the driving of the pile gripper and pile downward for the extent of the stroke. The pile gripper assembly incorporates guides slidable in parallel along the frame vertical extremities so as to maintain parallelism of the hydraulic actuator stroke, pile member and foundation support to avoid any binding forces.

Therefore, it is an object of the present invention to provide an improvement over the prior art in that each jacking apparatus utilized in the present foundation raising and supporting method simultaneously places two metal piles so as to distribute the load bearing potential at each foundation support point.

Further, it is also an object of the present invention to provide a foundation pile driving/lifting apparatus that is more efficient in operation.

It is still another object of the invention to provide a hydraulic pile driver that exerts maximum force to a pile member per unit of applied hydraulic pressure.

Finally, it is an object of the invention to provide a hydraulic pile driver that can be used with greater speed, reliability and safety.

Other objects and advantages of the invention will be evident from the following detailed description when read in conjunction with the accompanying drawings which illustrate the invention.

DETAILED DESCRIPTION OF THE INVENTION

Figure 1:
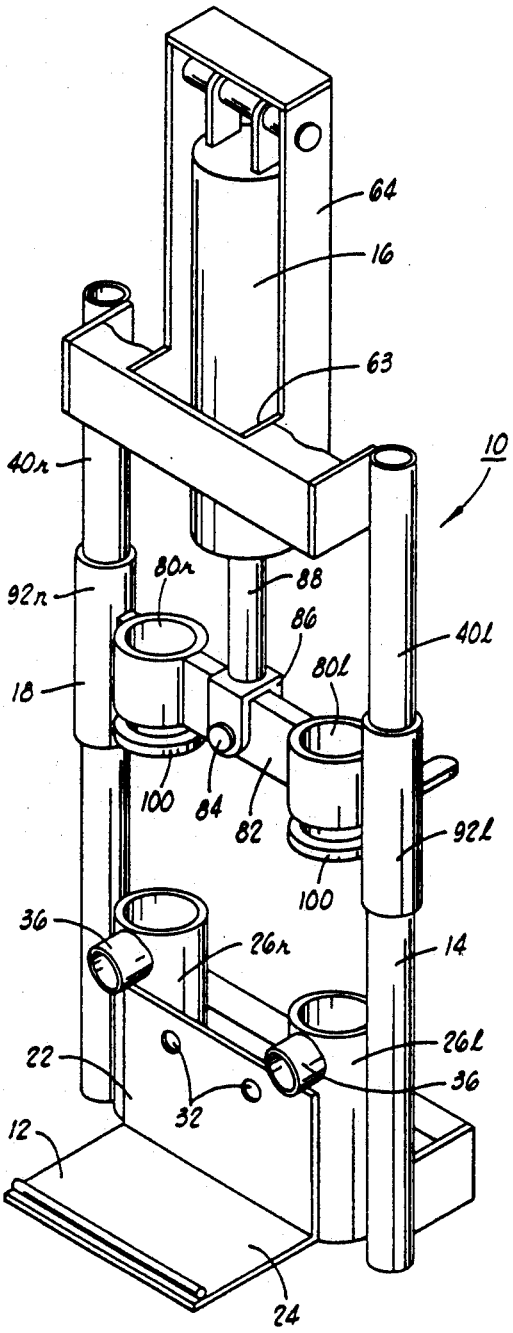
FIG. 1 is a perspective front view of the pile driving-/lifting apparatus.
Figure 2:
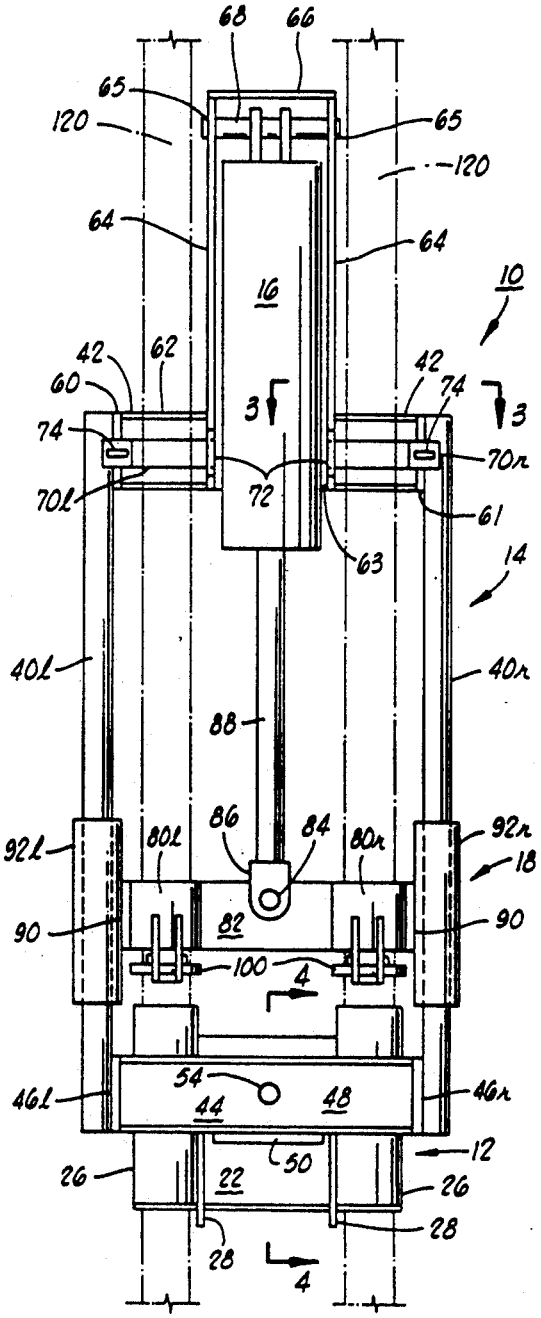
FIG. 2 is a back view in elevation of the pile driving-/lifting apparatus.

Referring to FIGS. 1 and 2, a pile driver/foundation lifting device 10 consists of a foundation support 12 having a frame assembly 14 rigidly attached thereto. From the frame assembly 14 extends a hydraulic actuator 16 downward into connection with a vertically slidable pipe gripper assembly 18.

Referring to FIGS. 1, 2, 4 and 9, the foundation support 12 is constructed of a backing plate 22 having a foot plate 24 at an angle of about 100 degrees. Two pile guide sleeves 26*l* and 26*r* are attached in a vertical position by welding to the rear side of the backing plate 22. Two brace plates 28 are welded in spaced disposition to the backing plate 22, foot plate 24 and guide sleeves 26*l* and 26*r* so as to provide rigidity and strength to the foundation support. An attachment plate 30 (FIG. 4) with a hole 31 is attached by welding between the two brace plates 28 (FIG. 9) so as to provide for the attachment of the frame assembly 14. Two holes 32 are provided in the backing plate 22 to allow for the attachment of the foundation support 12 to the foundation to be raised. A cylindrical bar or rod 34 is attached by welding across the front edge of foot plate 24 in order to prevent the foundation support from slipping from beneath the foundation during the driving/lifting process. See particularly FIG. 9. Two spacers 36 are welded to the vertical sleeves 26 to provide for horizontal contact with the foundation or slab so as to provide a bias and maintain proper positioning of the foundation support 12.

Figure 3:
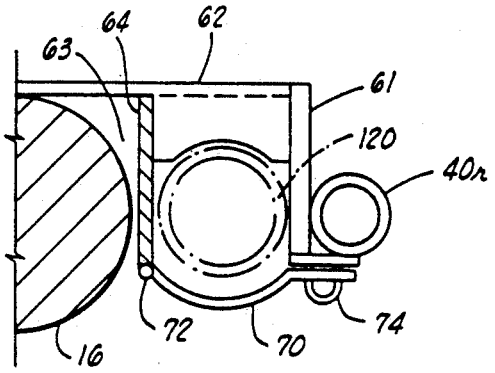
FIG. 3 is a partial plan view taken along line 3—3 of FIG. 2 showing the configuration of the upper elements of the frame assembly of the apparatus.

Referring to FIGS. 1, 2 and 3, the frame assembly 14 consists of two vertical side bars 40*l* and 40*r* interconnected by a top cross beam 42 and a bottom cross beam 44. The vertical side bars 40 may be constructed of suitable solid or tubular steel stock and are attached by welding to the top beam 42 and bottom beam 44. The bottom beam 44 is constructed of two steel side plates 46 welded to a structural steel cross member 48 to which is welded a horizontal plate 50 that further has a vertical plate 52 welded thereto. See FIG. 4. The vertical plate 52 includes a hole 51 which is in alignment with a hole 53 in cross member 48 and provides for attachment to the foundation support 12 by means of a pin 54. Pin 54 passes through the holes in vertical plate 52, cross member 48 and attachment plate 30 of the foundation support 12.

The top beam 42 of frame assembly 14 is constructed of two steel plates 60 and 61 which are welded on each end of a structural steel cross member 62. The cross member 62 is formed with a cutout portion 63 which provides clearance for attachment of the hydraulic actuator 16. Two plates 64 are attached by welding to cross member 62 (See FIGS. 2 and 3) and extend vertically upward to a top cross plate 66. The vertical plates 64 are provided with respective holes 65 which accept pin 68 and thus provide a pivotal attachment for the clevis end of the hydraulic actuator 16. The cross member 62 further has cutout portions formed to provide clearance for the passage of rod piles 120 (dash lines). Arcuate hasps 70 hingedly connected at points 72 may be secured at eyes 74 to capture the rod piles 120 at their upper ends.

Referring to FIGS. 1, 2, 5, 6, 7 and 8, the pile gripper assembly 18 is comprised of two pile guide sleeves 80*l* and 80*r* rigidly connected as by welding to cross plate 82. Cross plate 82 is provided with a hole to allow for the attachment by means of pin 84 of clevis 86 which is connected to rod 88 of the hydraulic actuator 16. Spacer plates 90 are connected by welding to the respective pile guide sleeve 80*l* and 80*r* in position diametrically opposed to cross plate 82. Guide sleeves 92*l* and 92*r* are slidably mounted on frame bars 40 and rigidly welded to opposite spacer plates 90 to result in an assembly whereby the axial centerlines of the two side guide sleeves 92*l* and 92*r* and the pile guide sleeves 80*l* and 80*r* lie in the same plane. Each pile guide sleeve 80 has attached by welding two parallel plates 94 (See FIG. 5) which extend downward to a point beneath the lower end of the respective pile guide sleeve 80. A pin 96 passes through aligned holes in respective pairs of plates 94 and through a respective transverse tubular member 98 welded to gripper plate 100*l* and 100*r* thus providing for the pivotal attachment of gripper plates 100 to respective pile guide sleeves 80. See FIGS. 5, 6 and 7. Stop plates 102 are welded to respective pairs of plates 94 in order to limit the downward pivotal movement of the respective gripper plate 100. The gripper plates 100 are constructed so as to have a hardened surface 101 along the internal circumference where the gripper plates contact the rod piles 120.

Figure 10:
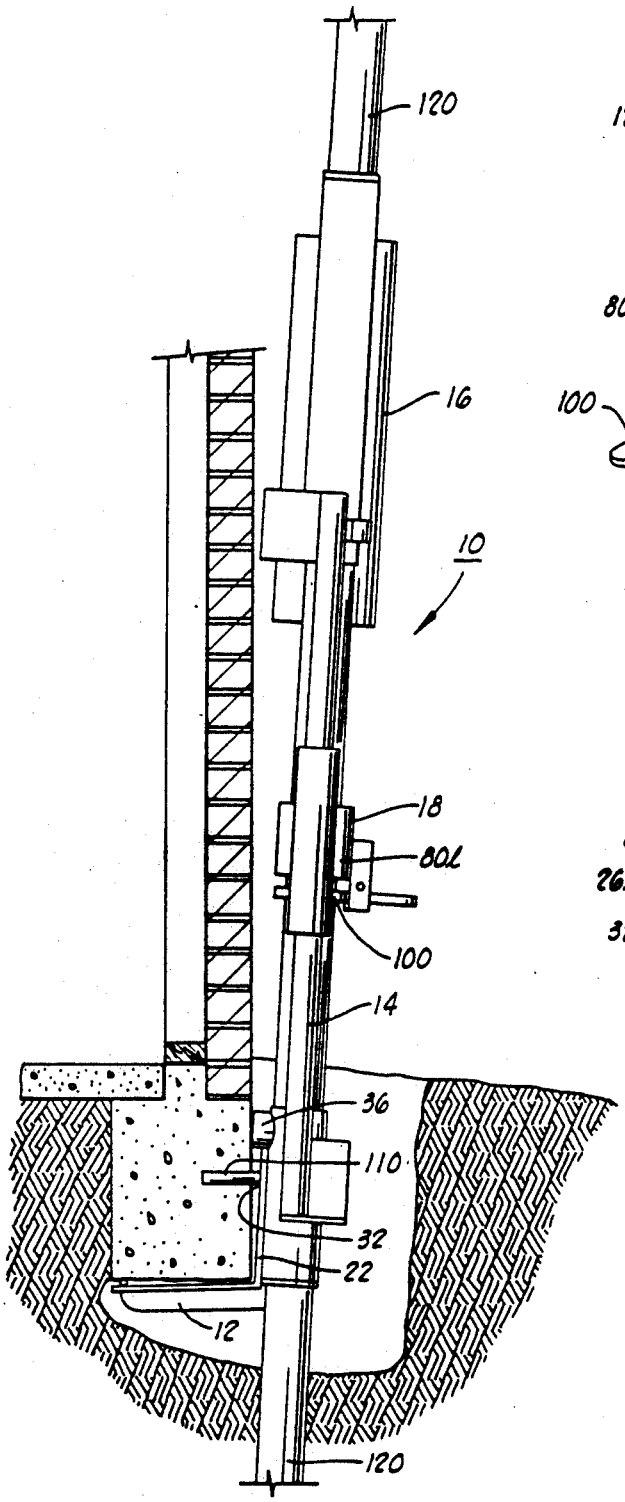
FIG. 10 is a side elevation showing the placement of the apparatus relative to a building foundation or slab as it is actually used in the field.

In operation, the foundation or slab lifting job dictates the number and position of rod piles to be placed and thus the total number of jacking devices to be employed. Referring to FIGS. 1, 2 and 10, at each dual pile location, excavation is made adjacent to the foundation to sufficient depth to allow the placement of foundation support 12. Two bores are made in the foundation in line with holes 32 in backing plate 22 so as to accept pins 110 which serve to secure the foundation support to the foundation. The pins ar driven into the bores in the foundation then welded to the rear side of the backing plate 22. A frame assembly 14 with a gripper assembly 18 and hydraulic actuator 16 is then connected to the foundation support 12 by means of pin 54 (See FIG. 4) as detailed earlier. Two rod piles 120 are then positioned through the gripper assembly pile guide sleeves 80 and respective gripper plates 100 and through the foundation support guide sleeves 26*l* and 26*r* into earth contact. The upper portions of the piles 120 are then locked into arcuate hasps 70*l* and 70*r*. The rod piles 120 may be used in varying length segments which are suitably interconnected along the total length.

Pressurization of hydraulic actuator 16 above the internal actuator piston (not shown) causes a downward thrust which is transferred through the actuator rod 88 and clevis 86 to the pile gripper assembly 18. This results in downward movement of the gripper assembly 18 relative to the frame assembly 14 and foundation support 12. During downward movement, the gripper plates 100 pivot upward with the internal hardened bore of the plates 100 contacting the piles 120 resulting in a binding force that effectively grips the piles and transfers the downward thrust to the piles driving them into the ground for the length of the stroke. Hydraulic pressure is then applied to the lower surface of the piston within the hydraulic actuator 16 resulting in an upward acting thrust which retracts the actuator rod 88. The retraction causes movement of the gripper assembly 18 upward relative to the frame assembly 14, foundation support 12 and piles 120. The stop plates 102 limit the downward pivotal movement of the gripper plates 100 to prevent the gripper plates from binding on the piles 120. The guide sleeves 92*l* and 92*r* of the gripper assembly 18 move slidably on the rods 40 of the frame assembly 14 serving to promote alignment of the frame assembly 14, gripper assembly 18 and hydraulic actuator 16 and thus preventing binding or bending of the rod piles 120. The expansion stroke-retraction stroke cycle is repeated until the lowermost end of the rod piles encounter bedrock or other load bearing strata or until a combination of pile end support and skin friction is encountered to provide the needed support for the foundation. Once support is established, the downward actuation pressure is exerted only in sufficient amount to correct the foundation squaring of the structure.

While the foregoing discussion addresses the use of one apparatus, in practice the procedure of raising a foundation would require the use of multiple apparatus to simultaneously reposition several points of the foundation or slab. Referring to the schematic of FIG. 11, &he method using the current invention utilizes one hydraulic power unit 200 to supply hydraulic pressure to a directional valve 202 which in turn alternately directs the pressure to two lines 210 and 220. The lines 210 and 220 are connected to respective ones of lines 212 and 222 which direct the hydraulic pressure in parallel to the actuators 16. Lines 212 and 222 are each fitted with a manual cutoff valve 214 and 224 which allow for the selection of actuators to be pressurized. Pressurization of line 210 by appropriate movement of directional valve 202 will result in the expansion stroke of the actuators 16 selected by way of the manual valves 214 and 224 while movement of the directional valve 202 in the opposite direction will alternately pressurize the line 220 resulting in the retraction stroke of the selected actuators. During the pile driving portion of the foundation leveling method, each pile driving apparatus with its actuator is selected individually utilizing the manual selection valves. Once all of the piles are driven, hydraulic pressure can be applied to the apparatus singularly or in groups to effect the proper positioning of the foundation or slab. After the proper position of the slab has been achieved, the rod piles 120 are welded to the upper end of the vertical guide sleeves 26 of the foundation supports 12. Excess pile material above the guide sleeves is cut away and the frame/gripper assembly is removed leaving the driven piles and foundation support in place. The excavation is then backfilled.

Figure 12:
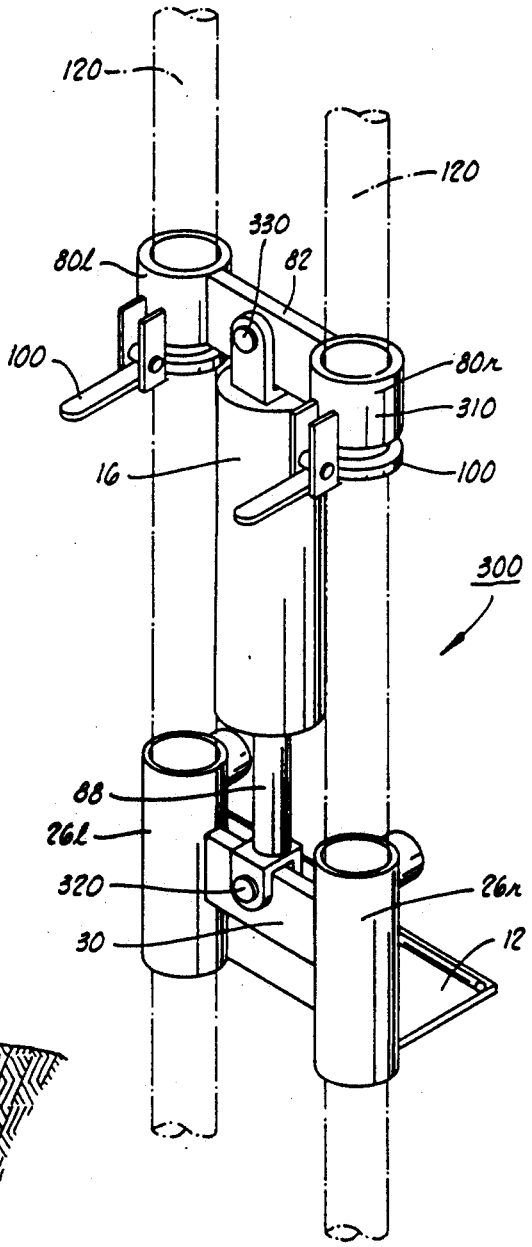
FIG. 12 is a perspective front view of an alternative form of apparatus.

Referring now to FIG. 12, an alternate arrangement of the components of the previously discussed device 10 results in a pile driver/foundation lifting device 300 consisting of a foundation support 12 pivotally attached to a hydraulic actuator 16 extending upward therefrom into pivotal connection with a pipe pile gripper assembly 310. Like elements are numbered the same.

Figure 4:
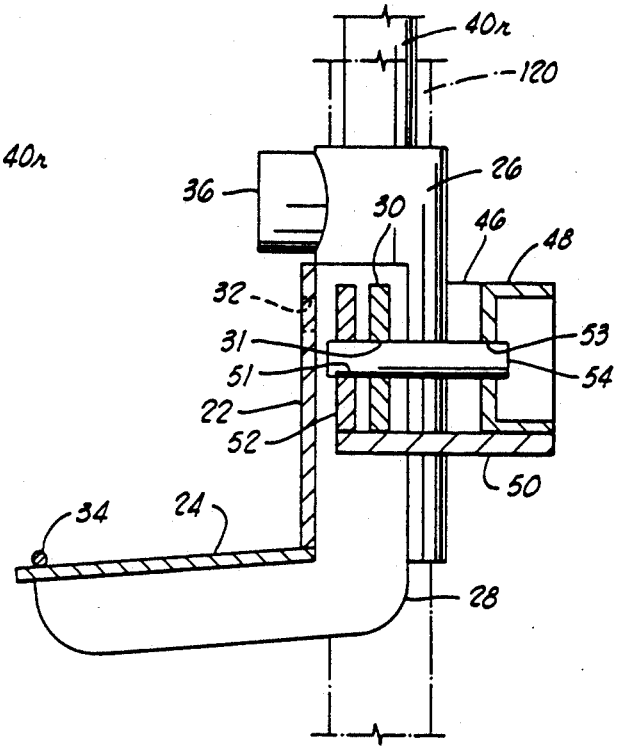
FIG. 4 is a cross section taken along line 4—4 of FIG. 2 showing details of the foundation support member and the lower elements of the frame assembly and the method by which they are interconnected.
Figure 5:
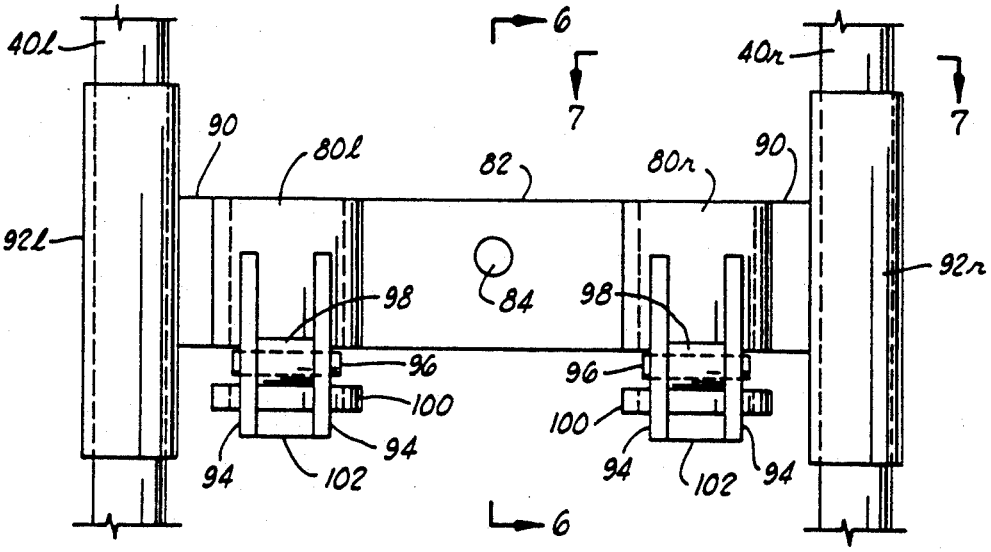
FIG. 5 is an elevation view of the pile gripper assembly.
Figure 6:
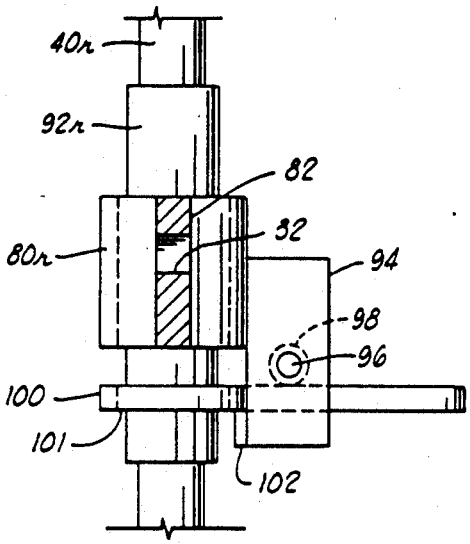
FIG. 6 is a cross section taken along line 6—6 of FIG. 5.
Figure 7:
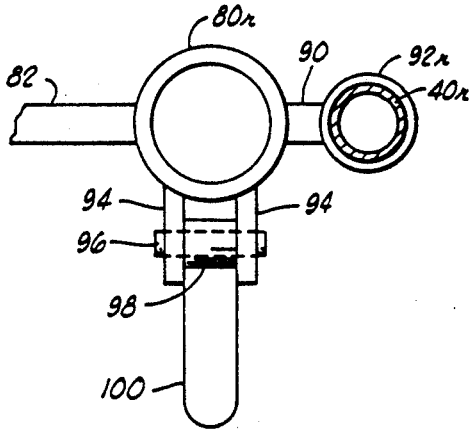
FIG. 7 is a partial plan view taken along line 7—7 of FIG. 5.
Figure 8:
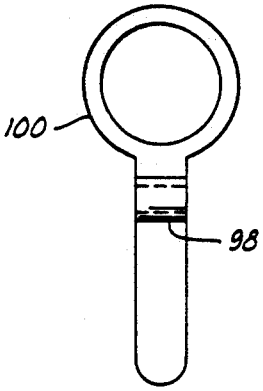
FIG. 8 is a plan view of the pivot plate member of the pile gripper apparatus.
Figure 9:
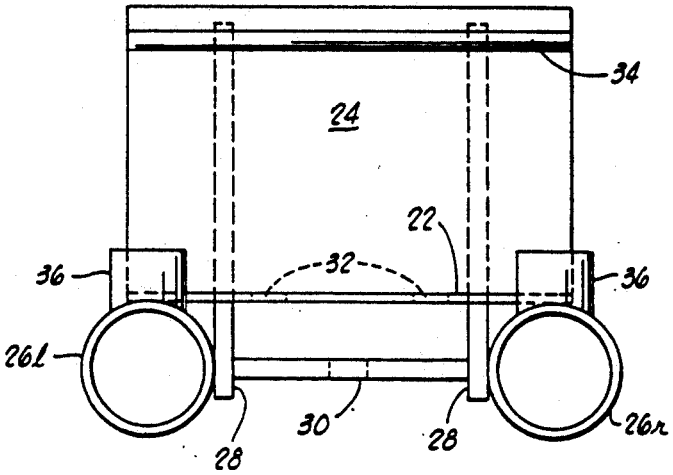
FIG. 9 is a plan view of the foundation support member.

Referring to FIGS. 4, 9 and 12, the foundation support 12 is identical in construction and function to the previously discussed arrangement. Referring to FIGS. 1, 5, 6, 7, 8 and 12, the pile gripper assembly 310 is substantially identical in construction and function to pile gripper assembly 18. The notable difference is the lack of guide sleeves 92 and spacer plates 90. As this arrangement does not utilize frame assembly 14, these components of the pile gripper assembly are not necessary. Otherwise the structure and function of pile guide sleeves 80, cross plate 82, plates 94, tubular members 98, gripper plates 100 and stop plates 102 are the same.

In operation, the foundation support 12 is placed adjacent to the foundation to be raised in an excavation suitably provided and attached to the foundation as previously discussed. The clevis of hydraulic actuator rod 88 is connected to the attachment plate 30 of foundation support 12 by means of pin 320. A pile gripper assembly 310 is then attached to the clevis of hydraulic actuator 16 by means of pin 330 which extends through the clevis and a hole in cross plate 82. Two rod piles 120 are then positioned through pile guide sleeves 80 and respective gripper plates 100 of the gripper assembly 310, and through guide sleeves 26 of foundation support 12 into earth contact. The rod piles 120 may be used in varying length segments which are interconnected along the total length.

Whereas the previously discussed arrangement utilized the expansion stroke of hydraulic actuator 16 to effect the gripping of the piles 120 and subsequent driving of the piles into the ground, the current arrangement utilizes the retraction stroke of the actuator 16 to effect the gripping and driving of the piles. The action of the components of gripper assembly 310 is the same in the downward stroke and upward stroke as discussed in the previous arrangement. The essential difference is, in the current arrangement, the downward or power stroke is effected by the retraction stroke of hydraulic actuator 16.

Figure 11:
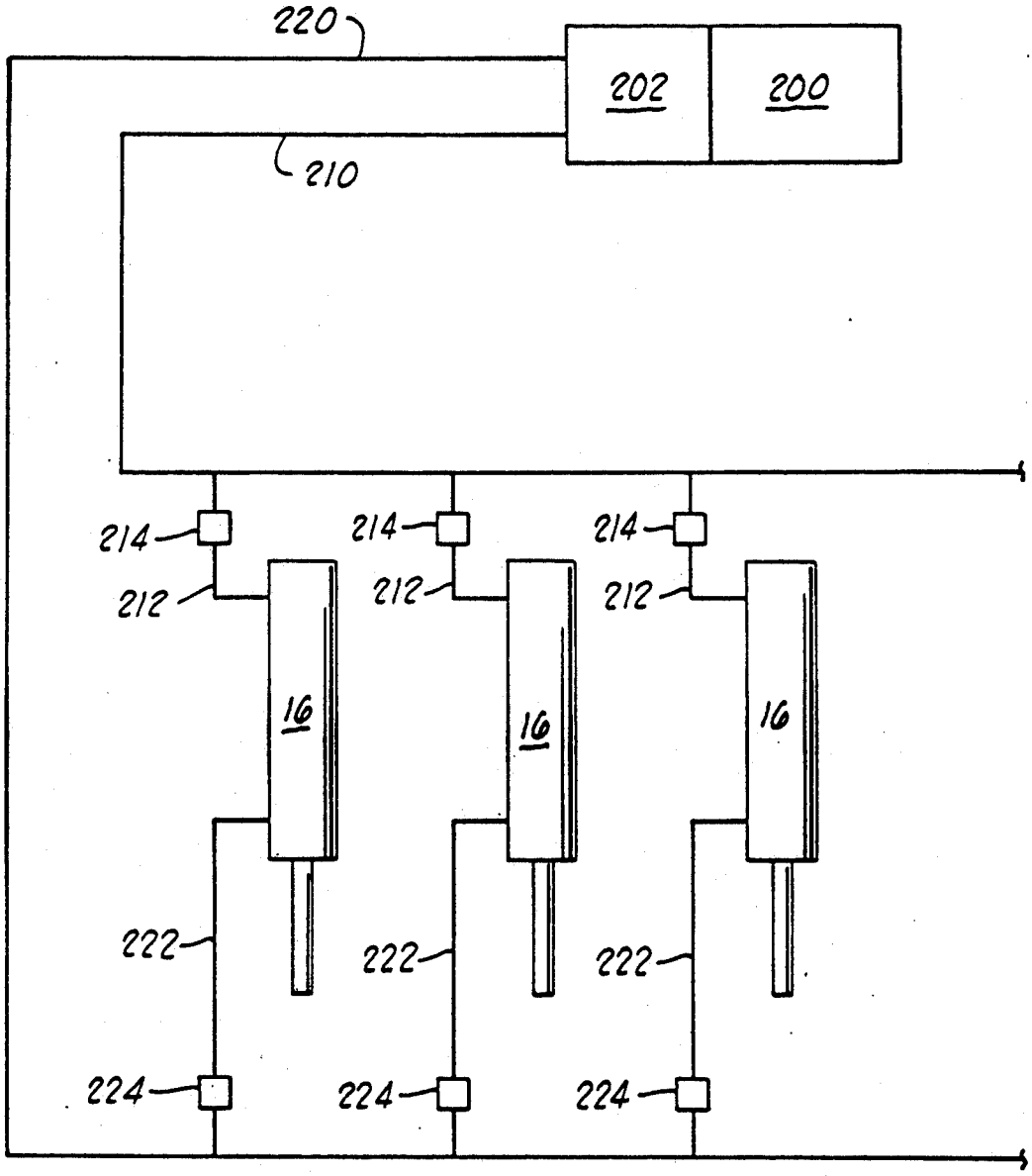
FIG. 11 is a schematic view of the hydraulic flow path used with this apparatus.

As in the previous arrangement, the expansion stroke-retraction stroke cycle is repeated until the lowermost end of the rod piles encounter bedrock or other load bearing strata or until a combination of pile end support and skin friction is encountered to provide the needed support for the foundation. Once support is established, the downward actuation pressure (retraction stroke) is exerted only in sufficient amount to correct the foundation squaring of the structure. The discussion of the previous arrangement referencing the hydraulic control schematic of FIG. 11 is equally applicable to the current arrangement as is the final securing of piles 120 by welding to guide sleeves 26 of foundation support 12, removal of excess pile material and backfilling of the excavations.

It should be noted with respect to the alternate arrangement, the rod piles 120 serve the function of providing linear alignment of the guide sleeves 26 of foundation support 12, the pile guide sleeves 80 of gripper assembly 310 and actuator 16 so as to prevent binding forces during the driving/lifting process.

The foregoing discloses novel improvements in hydraulic jacking devices for foundation or slab leveling. The present invention provides for the simultaneous placement of two parallel piles thus providing for increased distribution of the supported load. Further, the configuration of the members of the device results in no limitation on the length of the pile segments which can be used. Also, the configuration of the invention allows the application of maximum hydraulic force with minimal possibilities of binding or bending the rod pile stock.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for driving foundation leveling pile members and subsequently raising the foundation comprising:

a foundation support member including a horizontal foot plate, and a generally vertical backing plate extending upward therefrom, and two vertical guide sleeves rigidly secured to said backing plate in laterally spaced, parallel positions, said guide sleeves receiving two pile members therethrough in generally vertically directed, parallel orientation;

a gripper assembly including two pile guide sleeves rigidly joined by a central plate member disposed in vertical spacing over said two vertical guide sleeves, and including means for releasably gripping said two pile members in parallel configuration;

a hydraulic linear actuator interconnected between the foundation support member and the gripper assembly central plate member, said hydraulic actuator being disposed centrally in vertical alignment equidistant between the parallel vertical guide sleeves, said hydraulic actuator being energizable to close the gripping assembly and drive the piles downward during the retraction stroke.

2. Apparatus as set forth in claim 1 wherein said foundation support member further comprises:

a cylindrical bar welded across said foot plate to provide additional friction thereby to prevent slippage between the foundation and said foot plate.

3. Apparatus as set forth in claim 1 wherein:

the axes of said vertical guide sleeves, said hydraulic linear actuator, and said gripper assembly means for gripping two pile members all line in the same plane with the axes of said pile members, and the hydraulic linear actuator driving force is also applied in the same plane.

4. Apparatus as set forth in claim 1 wherein:

said gripper plates are adapted to clamp said pile members upon downward movement relative thereto and to disengage said pile members upon upward movement relative thereto.

* * * * *